US006968616B2

(12) United States Patent
Nakamura et al.

(10) Patent No.: US 6,968,616 B2
(45) Date of Patent: Nov. 29, 2005

(54) METHOD OF MANUFACTURING NOZZLE PLATE

(75) Inventors: Takashi Nakamura, Nagano (JP); Nagamitsu Takashima, Nagano (JP); Tatsuo Furuta, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 10/307,493

(22) Filed: Dec. 2, 2002

(65) Prior Publication Data

US 2003/0122900 A1 Jul. 3, 2003

(30) Foreign Application Priority Data

Dec. 3, 2001 (JP) ..... 2001-369166
Aug. 30, 2002 (JP) ..... 2002-253817

(51) Int. Cl.[7] ..... B21D 53/76; B41J 2/045

(52) U.S. Cl. ..... 29/890.1; 29/156 C; 29/412; 29/417; 29/424; 29/425; 29/432; 347/68

(58) Field of Search ..... 29/890.1, 156 C, 29/417, 412, 424, 432; 72/325, 465; 347/15, 347/92, 140, 47, 44, 46, 65, 68

(56) References Cited

U.S. PATENT DOCUMENTS

RE31,357 E * 8/1983 Cone ..... 346/75
4,425,777 A * 1/1984 Jeglinski ..... 72/325
4,574,445 A * 3/1986 Bentin et al. ..... 29/890.1
5,087,930 A * 2/1992 Roy et al. ..... 347/85
5,127,156 A * 7/1992 Yokoyama et al. .... 29/890.143
5,521,621 A * 5/1996 Endo et al. ..... 347/15
5,677,718 A * 10/1997 Crawford et al. ..... 347/92
5,754,194 A * 5/1998 Endo et al. ..... 347/15
6,170,934 B1 * 1/2001 Fujisawa et al. ..... 347/47

FOREIGN PATENT DOCUMENTS

EP 0 858 893 A2 8/1998
JP 07-060971 * 3/1995 ..... B41J 2/135
JP 10-226070 A 8/1998
JP 2000-289211 10/2000

OTHER PUBLICATIONS

English Translation of JP 07-060971.*

* cited by examiner

*Primary Examiner*—A. Dexter Tugbang
*Assistant Examiner*—Tai Van Nguyen
(74) *Attorney, Agent, or Firm*—Sughrue Mion, PLLC

(57) ABSTRACT

A nozzle plate is manufactured by providing a material plate and a punch. The material plate is punched by the punch to form a provisional nozzle orifice hole on the material plate. The punching is repeated such that the provisional holes formed by a given punch are arranged in line. A bulged portion which is bulged on a back side of the material plate is removed to form the completed nozzle orifice.

10 Claims, 8 Drawing Sheets

42
51
51
43
51
51

50A
50B
50C
50D
43
(22)
30A
30B
30D
30F
44
(21)
44
44
30C
30E
30G
30H
L1
L1
L1
L1
48
L2
L2
L2
42
52A
48
52B
42
42
52C
48
42
42

METHOD OF MANUFACTURING NOZZLE PLATE

BACKGROUND OF THE INVENTION

The present invention relates to a liquid jetting head such as a recording head for an ink jet type recording apparatus, a coloring material jetting head for a display manufacturing apparatus, an electrode material jetting head for an electrode forming apparatus or an organism jetting head for a biochip manufacturing apparatus, and a nozzle plate provided in the liquid jetting head and a method of manufacturing the nozzle plate.

A liquid jetting head can jet a liquid in a droplet state and typically includes a recording head used in an image recording apparatus such as an ink jet type printer or an ink jet type plotter and serving to jet a liquid ink. In addition, examples of the liquid jetting head include a coloring material jetting head used in a display manufacturing apparatus for manufacturing a color filter such as a liquid crystal display and serving to jet a liquid coloring material such as R (Red), G (Green) or B (Blue), an electrode material jetting head used in an electrode forming apparatus for forming an electrode such as an organic EL (Electro Luminescence) display or an FED (face emitting display) and serving to jet a liquid electrode material, and an organism jetting head used in a biochip manufacturing apparatus for manufacturing a biochip (a biochemical element) and serving to jet a liquid bioorganism.

In the liquid jetting head of this kind, a pressure generation chamber and a nozzle orifice are communicated with each other and a droplet is jetted from the nozzle orifice by utilizing a fluctuation in a pressure which is generated over a liquid in the pressure generation chamber. In general, tens to thousands of nozzle orifices are provided in a line to constitute a nozzle array, and a plurality of nozzle arrays are provided transversely. The nozzle orifice is fabricated by punching (a kind of plastic working) using a die and a punch. As shown in FIG. 7, a punch 1 is a round punch, for example, and has a base portion 2, a taper portion 3 and a straight portion (a cylindrical portion) 4, and is used in a fixation state to a punch holder (pressure receiving plate) 5. For example, a plurality of punches 1 are arranged and attached in a line with the base portion 2 turned toward the punch holder 5 side and each of the punches 1 is brought down toward a material plate 6 (a work for forming a nozzle plate, see FIG. 8), thereby pushing the straight portion 4 and the taper portion 3 into the material plate 6. At this time, as shown in FIG. 8, the direction of the arrangement of the punch 1 is aligned with the direction of the nozzle array 7, thereby carrying out the punching. Accordingly, a plurality of provisional holes 7 (that is, concave portions to be the nozzle orifice) corresponding to one nozzle array are fabricated by one-time to several time working. It is also possible to set the attachment pitch of the punch 1 to be a double and to move the punch holder 5 in the direction of the nozzle array corresponding to a nozzle pitch after the fabrication is carried out by the previous working, thereby forming a provisional hole in the middle of the provisional holes fabricated previously.

When the punch 1 is pushed into the material plate 6, the straight portion 4 and the taper portion 3 enter in a vertical direction while applying plastic deformation to the material plate 6. By pushing in the punch 1, the material plate 6 flows in conformity with the straight portion 4 and the taper portion 3 in the punch 1 so that a provisional hole having a shape in conformity with the punch 1 is formed. Moreover, a part of the material plate 6 is pushed into the concave hole of the die so that a bulged portion is formed. When the punch 1 is sufficiently pushed in, the punch 1 is lifted to be separated from the material plate 6 and the bulged portion is removed by polishing. Consequently, a nozzle orifice penetrating through the material plate 6 in the vertical direction is fabricated. The nozzle orifice thus fabricated acts as a funnel-shaped through hole including a straight portion and a taper portion.

The nozzle orifice requires very high precision in a dimension and a shape. For example, it is necessary to set the taper angle of the taper portion, the inside diameter of the straight portion and the length of the straight portion within a tolerance having very high precision. The reason is that the jet characteristic or flight direction of a droplet is varied due to a variation in the dimension or shape of the nozzle orifice. In the related manufacturing method, however, it is hard to set the dimensions and shapes of the nozzle orifices to be equal to each other with high precision.

The foregoing will be described based on a punch and a punch holder which are illustrated in FIG. 9. A first punch 1*a* positioned on a left end in FIG. 9A can form the ideal profile of the nozzle orifice, and a straight portion thereof has a diameter ϕd0, the straight portion has a length L0 and an attachment dimension from the pinch holder 5 to a punch tip is h0. The "nozzle profile" implies the shape of the nozzle orifice formed on a nozzle plate (that is, formed in conformity to a punch) by sliding with the punch. In a second punch 1*b* positioned adjacently to the first punch 1*a* on the right side, a straight portion has a larger diameter ϕd2 than that of the first punch and other portions have dimensions L0 and h0 which are equal to those of the first punch. In a third punch 1*c* positioned adjacently to the second punch 1*b* on the right side, a straight portion has a diameter ϕd0 and a length L0 which are equal to those of the first punch 1*a*, and an attachment dimension from the punch holder 5 to a punch tip is h3 which is shorter than that of the first punch 1*a*. In a fourth punch 1*d* positioned adjacently to the third punch 1*c* on the right side, a straight portion has a diameter (ϕd0 and a length L0 which are equal to those of the first punch 1*a*, and an attachment dimension from the punch holder 5 to a punch tip is h4 which is longer than that of the first punch 1*a*. In a fifth punch 1*e* positioned adjacently to the fourth punch 1*d* on the right side, a diameter of a straight portion and an attachment dimension from the punch holder 5 to a punch tip are ϕd0 and h0 which are equal to those of the first punch 1*a*, and the straight portion is a length L5 which is smaller than that of the first punch 1*a*.

In the case in which a plurality of provisional holes constituting one nozzle array are processed at the same time by the punches 1*a* to 1*e*, a material plate has a sectional shape shown in FIG. 9B after the punching and the material plate has a sectional shape shown in FIG. 9C after the bulged portion formed on the back side is removed. In a first nozzle orifice having an ideal profile by processing with the first punch 1*a*, it is assumed that a straight portion has a length m0 and a diameter ϕd0. In this case, in a second nozzle orifice processed by the second punch 1*b*, a straight portion has a length m0 in the same manner as the first nozzle orifice and the diameter ϕd1 of the straight portion is larger than the diameter ϕd1 of the first nozzle orifice. In a third nozzle orifice processed by the third punch 1*c*, moreover, a straight portion has a greater length m3 than the length m0 of the first nozzle orifice because the attachment dimension h3 of the third punch 1*c* is smaller than the attachment dimension h0 of the first punch 1*a*. To the contrary, in a fourth nozzle orifice processed by the fourth punch 1*d*, the entrance depth of a punch tip to the material plate 6 is greater than that of the first punch 1*a* because the attachment dimension h4 of the fourth punch 1*d* is greater than the attachment dimension h0 of the first punch 1*a*. As a result, the length m4 of the straight portion is smaller than the length m0 in the first nozzle orifice. In a fifth nozzle orifice processed by the fifth punch 1*e* which originally has a shorter straight portion than that of the first punch 1*a*, furthermore, it is a matter of course that the length m5 of the straight portion is also smaller than the length m0 in the first nozzle orifice.

Thus, the dimension of the nozzle orifice formed finally is varied and the jet characteristic of a droplet is varied for each nozzle orifice due to a variation in the dimension of the punch 1 or a variation in an attachment state to the punch holder 5. For example, when the length of the straight portion is too great, a jet efficiency is deteriorated so that the amount of a jetted liquid is decreased at a driving voltage according to a design value. As a result, the driving voltage is to be raised. To the contrary, if the length of the straight portion is small, a meniscus (a free surface of a liquid exposed from the nozzle orifice) is apt to be influenced by the surplus vibration of a liquid stored in a pressure generation chamber. Consequently, there is a drawback that a jet stability, that is, a stability of the amount of a droplet or a flight direction is deteriorated.

If the length of the straight portion in the nozzle orifice is managed to be 20 $\mu$m±5 $\mu$m, it can be guessed that a variation in a profile of each nozzle orifice can exceed an acceptable value in a related method of simultaneously processing the nozzle orifice in a line by using a plurality of punches 1 in consideration of the cause of a variation such as processing precision in the punch 1, precision in the attachment of the punch 1 to the punch holder 5, precision in the push-in dimension of a processing machine or precision in the processing of removing the bulged portion.

SUMMARY OF THE INVENTION

It is therefore an object of the present invention to provide a liquid jetting head capable of fabricating a nozzle orifice having a uniform dimension and shape, and furthermore, carrying out liquid injection uniformly and stably.

In order to achieve the above object, according to the present invention, there is provided a method of manufacturing a nozzle plate comprising the steps of:

providing a material plate;

providing a punch;

punching the material plate by the punch so as to form a provisional hole to be a nozzle orifice on the material plate;

repeating the punching step such that the provisional holes formed by the punch are arranged in line; and removing a bulged portion which is bulged on a back side of the material plate by the forming step so as to form the nozzle orifice.

In the above method, the provisional holes belonging to the same nozzle array are fabricated by the processing using the same punch. Therefore, each of the nozzle orifices belonging to the same nozzle array has a nozzle profile aligned with high precision (that is, which implies the shape of the nozzle orifice formed by sliding with the punch and is simply referred to as a profile). Consequently, the jet characteristic of a droplet can be made uniform on a high level.

Preferably, a plurality of nozzle arrays, each nozzle array having the nozzle orifices arranged in line on the material plate, are arranged in parallel each other.

Here, it is preferable that, a plurality of punches are provided in a first direction in which the nozzle arrays are arranged. The nozzle orifices of the nozzle array corresponding to each punch are formed by the corresponding punch.

In the above methods, the provisional holes for the nozzle arrays can be processed at the same time. Therefore, productivity can be enhanced. Moreover, it is necessary to prepare a plurality of punches. However, since the number of the nozzle arrays to be processed is enough, the number itself is not increased remarkably. Consequently, it is sufficiently possible to prepare a plurality of punches having equal dimensions and to attach the punches to a punch holder with high precision in the dimension. In a liquid jetting apparatus of this kind, furthermore, driving conditions can be set to each nozzle array. Therefore, even if the precision in the dimension or attachment of the punch is varied so that the nozzle profile is varied between the nozzle arrays, a countermeasure can easily be taken by setting the driving conditions.

Here, it is preferable that, a punch set includes the punches attached to a holding member at an interval between the nozzle arrays. The method further comprises the step of moving the punch set in the first direction to perform the punching step for a next plurality of nozzle arrays after the punching step for the nozzle arrays is finished.

In the above method, the punching for the other nozzle arrays is performed after the punching for the nozzle arrays is ended by the punches, that is, the punching progresses on a punch set unit. Consequently, the processing can be carried out more efficiently so that productivity can be enhanced.

Here, it is preferable that, the punching step is performed such that formation intervals between the nozzle arrays are equal to each other. Attachment intervals between the punches of the punch set are integer times as much as the formation interval. The moving step is performed such that the punch set is moved by the formation interval.

In the above method, during the punching step, it is possible to easily set the amount of movement in the first direction. Consequently, the provisional hole can be formed with high precision in a position and the processing can be carried out more efficiently.

Here, it is preferable that, a nozzle array set is constituted by a pair of the adjacent nozzle arrays. The punching step is performed such that an array interval between the nozzle array sets is larger than the formation interval between the nozzle arrays of the nozzle array set. The moving step is performed such that the punch set is moved to perform the punching step for other plurality of nozzle arrays after the punching step for the nozzle arrays by the punch sets is finished.

Here, it is preferable that, the attachment interval between the punches of the each punch set is equal to the formation interval between the nozzle arrays of the nozzle array set. The moving step is performed such that the punch set is moved by the array interval between the nozzle array sets.

In the above methods, the processing can be carried out more efficiently so that the productivity can be enhanced. Moreover, it is possible to easily set the amount of movement in the first direction during the punching step. Consequently, the provisional hole can be formed with high precision in a position and the processing can be carried out more efficiently.

Preferably, a large-sized material plate capable of fabricating a plurality of nozzle plates is used for the material plate. Further the method comprises the step of dividing the large-sized material plate into the plurality of nozzle plates.

In the above method, the provisional hole forming step and the bulged portion removing step are carried out for the large-sized material plate to perform a required processing and the large-sized material plate is then divided into a plurality of nozzle plates at the dividing step. Therefore, it is possible to remarkably enhance the productivity of the nozzle plate. In the method, furthermore, also in the case in which plural kinds of nozzle plates having different arrangement patterns of the nozzle array are to be fabricated from one large-sized material plate, a countermeasure can be taken by setting the number of the punches to be used or an interval between the punches and setting the amount of movement in the first direction. Consequently, the processing can be carried out with higher productivity.

Here, it is preferable that, the punch set has the number of punches which corresponds to the number of nozzle arrays to be formed on the nozzle plate. The punching step is performed with respect to the plurality of nozzle plate simultaneously.

In the above method, a plurality of punch sets simultaneously process the provisional holes of corresponding nozzle plates thereto, respectively. Consequently, the processing can be carried out more efficiently so that the productivity can be enhanced.

Here, it is preferable that, the punching step is performed such that the nozzle arrays are formed on each nozzle plate by the corresponding punch set simultaneously.

In the above method, the provisional hole of each of the nozzle plates is processed simultaneously. Therefore, the processing can be carried out more efficiently so that the productivity can be enhanced.

Here, it is preferable that, the punching step is performed such that the provisional holes corresponding to a surplus nozzle array are punched in a surplus region of the large-sized material plate.

In the above method, the provisional hole is extra punched intentionally in the surplus region of the large-sized material plate. Therefore, it is possible to fabricate the nozzle plate without a hindrance even if surplus provisional hole lines are generated based on the relative relationship between the number of the nozzle arrays to be formed on the large-sized material plate and the number of the punches to be used. Consequently, it is possible to minimize the type of the punches to be used. Moreover, even if the specification of the nozzle plate is changed, a countermeasure can easily be taken and existing equipment can be utilized effectively.

According to the present invention, there is also provided a nozzle plate provided in a liquid jetting head capable of jetting a droplet, comprising:

a plurality of nozzle arrays which are arranged on the nozzle plate in parallel each other, each nozzle array having a plurality of nozzle orifices which are arranged in line, and wherein a first tolerance of the nozzle orifices of the nozzle array is smaller than a second tolerance of the nozzle orifices between the nozzle arrays in a nozzle profile which indicates a shape of the nozzle orifice.

Preferably, the nozzle profile indicates a shape of a cylindrical portion of the nozzle orifice which is positioned on a droplet jetting side of the nozzle plate. The first tolerance is smaller than the second tolerance in the nozzle profile.

In the above configuration, referring to the nozzle profile, the tolerance in the nozzle array is set to be smaller than the tolerance between the nozzle arrays. Referring to the jet characteristic of a droplet, therefore, a variation in each of the nozzle orifices belonging to the same nozzle array is smaller than a variation between the nozzle arrays. More specifically, a variation in the jet characteristic which is caused by the profile of the nozzle orifice is determined for each nozzle array.

The jet control of the droplet in the liquid jetting head of this kind is usually carried out for each nozzle array. For example, the driving voltage and the driving waveform of a driving pulse to jet the droplet can be set on a nozzle array unit. Moreover, the control of the amount of an impact liquid per unit area is also carried out on a nozzle array unit. The reason is that each component such as a pressure generating element or a pressure generation chamber causing a fluctuation in a pressure over a liquid in the pressure generation chamber is fabricated on a nozzle array unit and a difference in a characteristic and a difference in a shape are apt to be made on the nozzle array unit.

Referring to the variation in the jet characteristic of the droplet, accordingly, the variation in the nozzle array is set to be smaller than the variation between the nozzle arrays. Consequently, it is possible to correct the variation in a characteristic caused by the shape of the nozzle orifice corresponding to the variation in a characteristic caused by each component such as a pressure generating element or a pressure generation chamber. Consequently, the regulation can easily be carried out.

According to the present invention, there is also provided a liquid jetting head comprising;

a nozzle plate, including a plurality of nozzle arrays which is arranged in parallel each other thereon, each nozzle array having a plurality of nozzle orifices which are arranged in line, a flow path board, provided with a plurality of pressure generation chambers communicating with the nozzle orifices; and a pressure generating element, generating a fluctuation in a pressure over a liquid filled in the pressure generation chamber, wherein the nozzle orifices of the nozzle array have a nozzle profiles which are formed by a single punch, the nozzle profile indicating a shape of the nozzle orifice.

Preferably, the nozzle profile indicates a shape of the nozzle orifice which has a cylindrical portion positioned on a droplet jetting side of the nozzle plate, a taper portion which is positioned on the flow path board side and which expands toward the flow path board side, and a curved face portion connecting the cylindrical portion and the taper portion continuously.

Here, it is preferable that, the plurality of nozzle arrays are respectively correspond to kinds of liquids to be jetted therefrom.

In the above configurations, the nozzle orifice belonging to the same nozzle array has the nozzle profile by the same punch. Therefore, the nozzle profile in each nozzle is aligned with high precision. In the same nozzle array, therefore, it is possible to more greatly reduce a variation in the jet characteristic caused by the shape of the nozzle orifice.

The jet control of the droplet in the liquid jetting head of this kind is usually carried out for each nozzle array. For example, the driving voltage of a driving pulse to jet the droplet is set on a nozzle array unit. Moreover, the control of the amount of an impact liquid per unit area is also carried out on the nozzle array unit. The reason is that each component such as a pressure generating element or a pressure generation chamber causing a fluctuation in a pressure over a liquid in the pressure generation chamber is fabricated on the nozzle array unit and a difference in the characteristic and a difference in a shape are apt to be made on the nozzle array unit.

Accordingly, the nozzle orifices belonging to the same nozzle array have the nozzle profile by the same punch. Therefore, it is sufficient that the jet characteristic is corrected on the nozzle array unit. Consequently, the regulation can be simplified.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Embodiments of the invention will be described below with reference to the drawings. In the following description, an ink jet type recording head (hereinafter referred to as a "recording head") to have a configuration of a liquid jetting head will be taken as an example.

Figure 1:
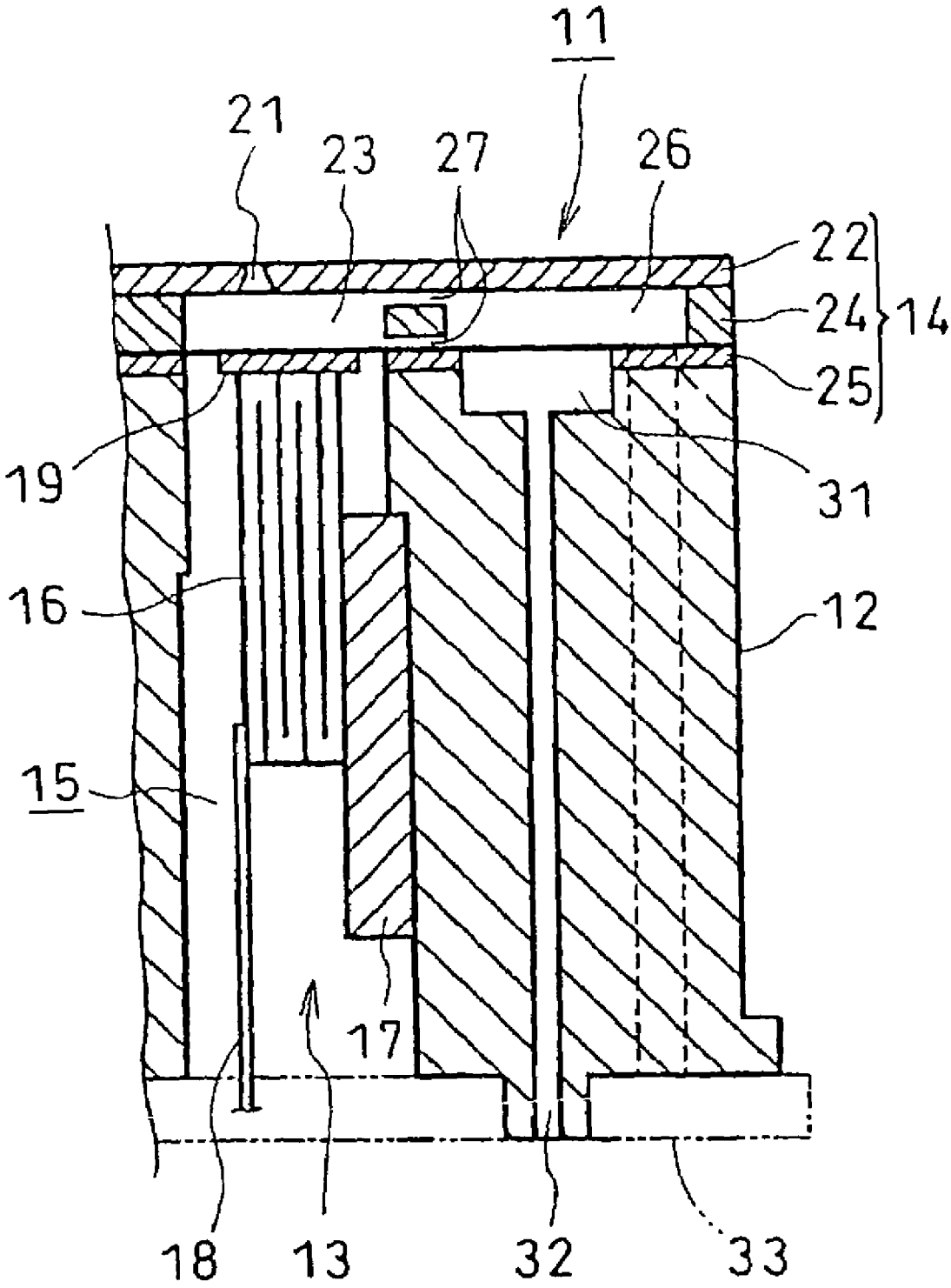
FIG. 1 is a sectional view showing an ink jet type recording head.

First of all, the structure of a recording head 11 will be described with reference to FIG. 1. The recording head 11 thus illustrated is schematically constituted by a head case 12, a vibrator unit 13 accommodated in the head case 12, and a flow path unit 14 bonded to the tip face of the head case 12.

The head case 12 is a component to be the base member of the recording head 11 and is a block-shaped member fabricated by injection molding a thermosetting resin and a thermoplastic resin, for example. A housing space portion 15 for accommodating a vibrator unit 13 is formed in the head case 12. The vibrator unit 13 is constituted by a plurality of piezoelectric vibrators 16 fabricated like comb-teeth, a fixing plate 17 to which each of the piezoelectric vibrators 16 is bonded, and a lead wire 18 for inputting a driving signal to the piezoelectric vibrator 16. The piezoelectric vibrator 16 is bonded to the fixing plate 17 in a state in which a free end is protruded outward from the tip edge of the fixing plate 17, that is, in the state of a cantilever. Moreover, the lead wire 18 is electrically connected to the piezoelectric vibrator 16 at the fixing end of the piezoelectric vibrator 16. The vibrator unit 13 has an attachment face of the fixing plate 17 on the opposite side of the piezoelectric vibrator 16 which is bonded to the internal wall face of the head case 12. Moreover, the tip face of the piezoelectric vibrator 16 (the tip face of the free end) faces an opening on the flow path unit 14 side in the housing space 15, and is bonded to an island portion 19 provided in the flow path unit 14.

The flow path unit 14 includes a nozzle plate 22 provided with a plurality of nozzle orifices 21, a flow path board 24 provided with a plurality of pressure generation chambers 23 communicating with the nozzle orifices 21, and a vibrating plate 25 for partitioning a part of the pressure generation chamber 23. The flow path unit 14 has such a structure that the nozzle plate 22 is bonded to one of the faces of the flow path board 24 and the vibrating plate 25 is bonded to the other face thereof.

The flow path board 24 is fabricated by a silicon wafer or a metal plate, for example. In the embodiment, the silicon wafer is etched to form a plurality of pressure generation chambers 23, an ink storage chamber 26 for storing an ink introduced into the pressure generation chamber 23 (that is, a reservoir to be a common liquid chamber), and an ink flow path 27 (supply port) to be a throttle flow path for causing the pressure generation chamber 23 to communicate with the ink storage chamber 26.

Figures 4A, 4B:
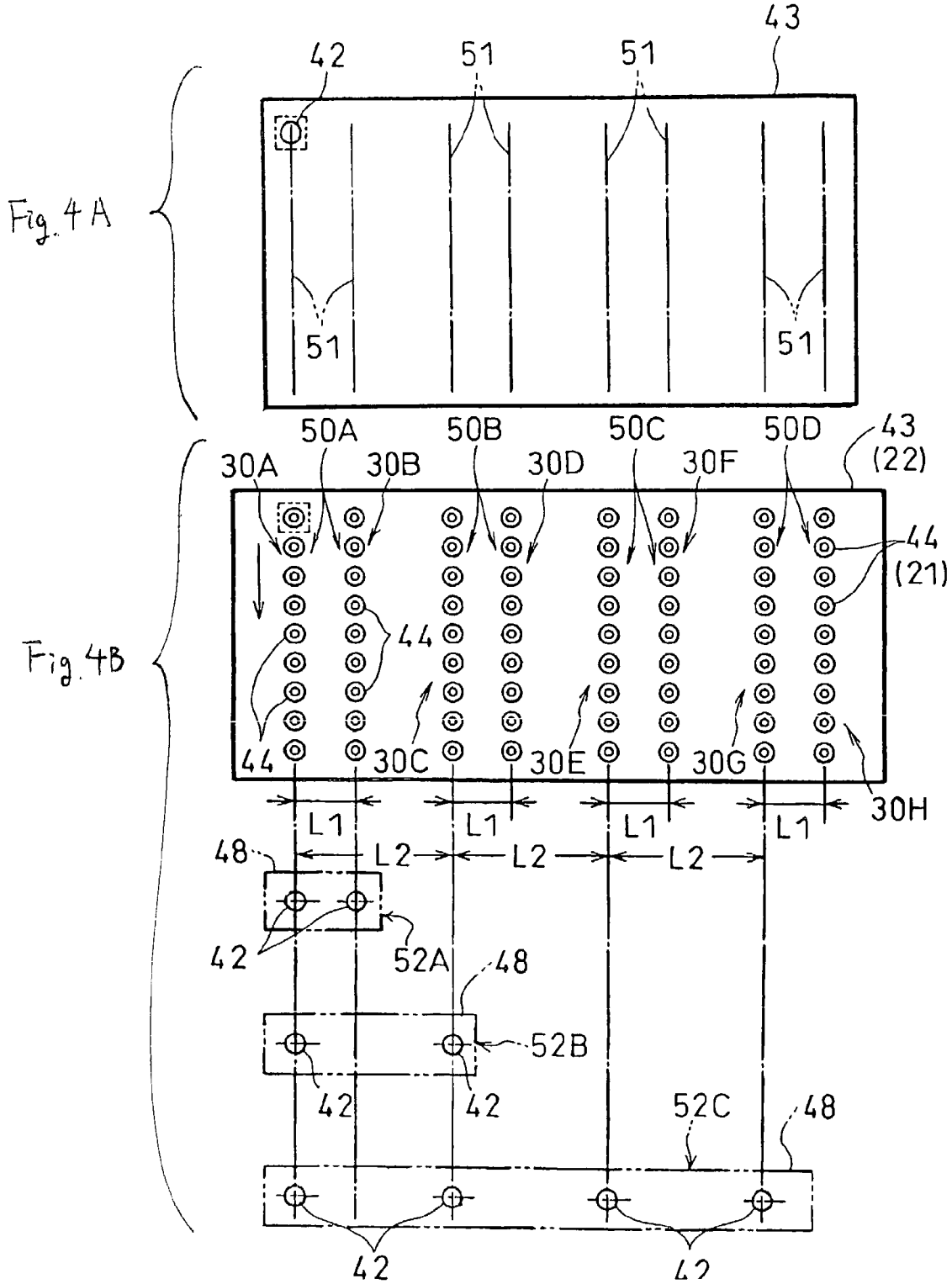
FIGS. 4A and 4B are views illustrating a provisional hole forming step according to first and second embodiments.

The nozzle plate 22 is fabricated by a thin stainless plate, for example. The nozzle plate 22 is provided with a plurality of nozzle orifices 21 in a pitch corresponding to a dot formation density as shown in FIG. 4B; for example. One nozzle array 30 (30A to 30H) is constituted by the nozzle orifices 21 provided on a straight line, and is provided transversely in a plurality of lines. In an example shown in the drawing, eight nozzle arrays 30A to 30H in total are formed for each type of the ink which can be jetted (that is, for each type of a liquid). Each portion such as the pressure generation chamber 23, the ink storage chamber 26 or the piezoelectric vibrator 16 is provided for each nozzle array 30 such that an ink having a predetermined color can be jetted for each nozzle array 30, which is not shown.

The vibrating plate 25 employs a double structure having an elastic film such as a PPS film on a support plate formed of stainless, and the support plate is etched circularly and an island portion 19 is formed in the circle in a portion corresponding to the pressure generation chamber 23. Moreover, the support plate in a portion corresponding to the ink storage chamber 26 is also removed by the etching to be a compliance portion for only the elastic film. A concave portion 31 for a damper is formed on a face at the flow path unit 14 side in the head case 12. The concave portion 31 for a damper is a space portion for maintaining a space for the operation of the vibrating plate 25 (compliance portion) for partitioning a part of the ink storage chamber 26 and is opened to the air through an external communicating path 32 provided in the head case 12.

The lead wire 18 is electrically connected through a head board 33 shown in a two-dotted chain line to a flexible flat cable which is not shown, and the flexible flat cable is electrically connected to a driving circuit which is not shown. When a driving signal sent from the driving circuit (in detail, a driving pulse included in the driving signal) is input (supplied) to the piezoelectric vibrator 16, the free end of the piezoelectric vibrator 16 is expanded and contracted in the longitudinal direction of an element. By the expansion and contraction of the free end, the island portion 19 is pushed toward the pressure generation chamber 23 side or is pulled in such a direction as to be separated from the pressure generation chamber 23 so that the volume of the pressure generation chamber 23 fluctuates. The pressure of the stored ink is changed by a fluctuation in the volume of the pressure generation chamber 23. By controlling the pressure of the ink, therefore, it is possible to jet ink drops from the nozzle orifice 21.

Next, description will be given to a method of manufacturing the nozzle plate 22. The nozzle plate 22 is fabricated by sequentially carrying out a provisional hole forming step of arranging a plurality of provisional holes on a material plate by punching and a bulged portion removing step of removing a bulged portion bulged to the back side of the material plate at the provisional hole forming step.

Figure 2:
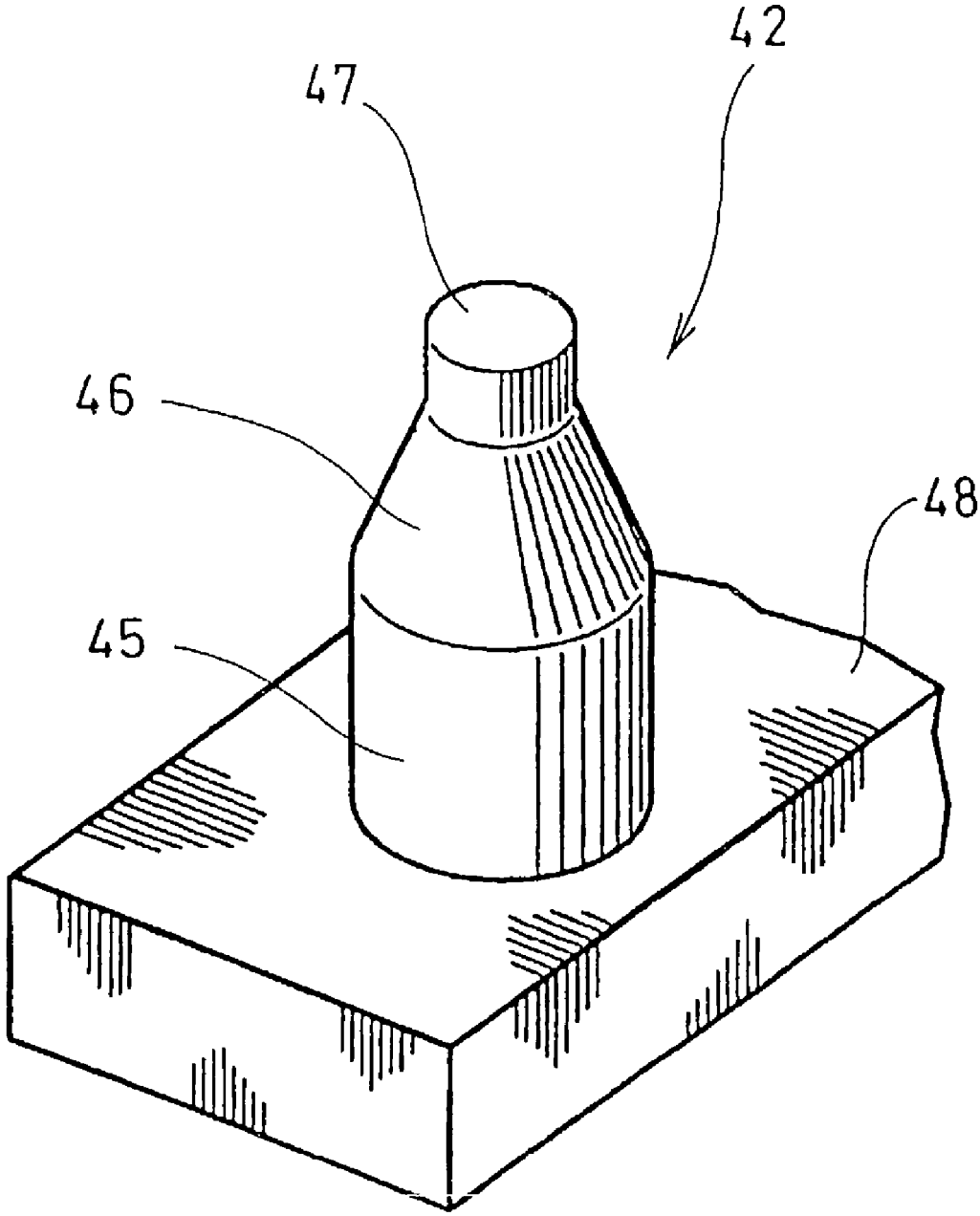
FIG. 2 is a perspective view showing a simple punch.
Figure 3A:
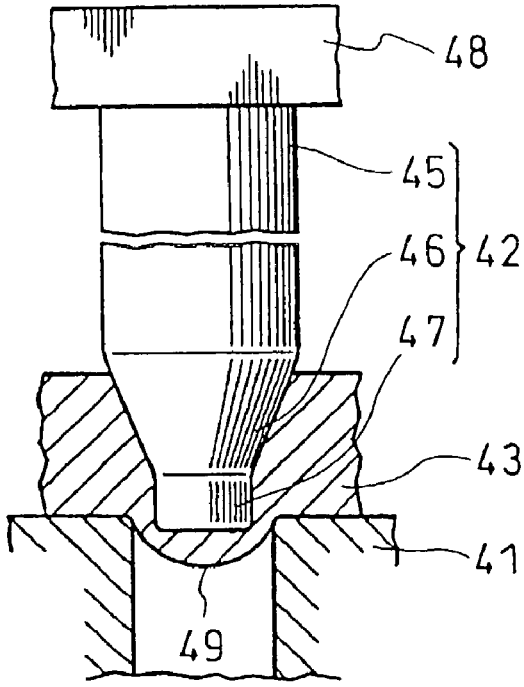
FIGS. 3A to 3C are sectional views showing a provisional hole forming step.
Figure 3B:
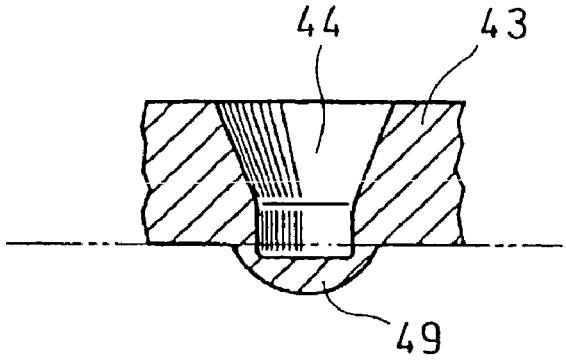

At the provisional hole forming step, a plurality of provisional holes 44 are formed on a material plate 43 by using a die 41 and a punch 42 shown in FIGS. 2 and 3. The material plate 43 is a thin plate to be a basis of the nozzle plate 22 and stainless steel to be a kind of a metal plate is used in the embodiment. For the material plate 43 (that is, the nozzle plate 22), the stainless steel is not restricted but an optional material can be used. For example, a thin nickel plate may be used. For example, the punch 42 is a round punch as shown in FIG. 2 and is constituted by a circular base portion 45, a taper portion 46 having a tapered shape provided on the tip side from the base portion 45, and a cylindrical straight portion (cylindrical portion) 47 which is a size thinner than the base portion 45. The punch 42 is fixed to a punch holder (pressure receiving plate) 48 for use. For example, a plurality of punches 42 are arranged in a line and are thus fixed with the base portion 45 turned toward the punch holder 48 side, and the punch 42 is brought down toward the material plate 43 mounted on the die 41. When the punch 42 is pushed into the material plate 43, the straight portion 47 and the taper portion 46 enter while causing the material plate 43 to flow as shown in FIG. 3A. When the punch 42 is pushed in by a sufficient depth, the provisional hole 44 having such a shape as to conform to the punch 42 is formed on the material plate 43. At this time, a part of the material plate 43 is pushed into the concave hole of the die 41, thereby forming a bulged portion 49. When the punch 12 is sufficiently pushed in, the punch 42 is lifted to be isolated from the material plate 43 (a state shown in FIG. 3B).

Figure 3C:
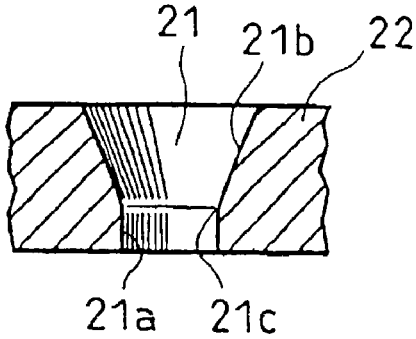

When the punch 42 is isolated, the bulged portion removing step is started to remove the bulged portion 49. At the bulged portion removing step, for example, a face on the bulged portion 49 side is polished up to a virtual plane shown in a two-dotted chain line of FIG. 3B. At the bulged portion removing step, it is also possible to employ a method other than polishing if the bulged portion 49 can be removed. By the removal of the bulged portion 49, as shown in FIG. 3C, a funnel-shaped nozzle orifice 21 penetrating through the material plate 43 in a vertical direction is formed. The profile of the nozzle orifice 21 is constituted by a straight portion 21*a* positioned on the jet side of an ink drop and having a circular section, a taper portion 21*b* positioned on the flow path board 24 side and expanded toward the flow path board 24 side, and a curved face portion 21*c* for causing the straight portion 21*a* and the taper portion 21*b* to continue smoothly.

The invention is characterized by a processing of the provisional hole 44 (punch hole) at the provisional hole forming step. The provisional hole forming step will be described below. FIG. 4 is a view illustrating the processing of the provisional hole 44, FIG. 4A showing the material plate 43 which has not been subjected to the punching and 4B showing the material plate 43 obtained after the punching. In the material plate 43 thus illustrated, eight provisional hole lines to be the nozzle arrays 30 are provided transversely (for convenience, a first nozzle array 30A to an eighth nozzle array 30H are sequentially set from the left side in the drawing), and a nozzle array set 50 (50A to 50D) is constituted by a pair of nozzle arrays 30 which are adjacent to each other. Furthermore, an array interval L2 between the nozzle array sets 50 is set to be greater than a formation interval L1 between the nozzle arrays 30 in the nozzle array set 50.

The first embodiment has a feature that the same punch 42 is used to form a plurality of provisional holes 44 belonging to the same nozzle array 30. In the embodiment, various methods can be proposed for the formation of the provisional holes 44. For example, it is possible to propose a method of forming the provisional hole 44 from the first nozzle array 30A to the eighth nozzle array 30H in order by one punch 42. Moreover, it is also possible to employ a method of forming the provisional holes 44 in the nozzle arrays 30A to 30H by eight punches 42 in total by causing one punch 42 to correspond to one nozzle array 30, that is, a method of arranging a plurality of punches 42 which are independently movable in the direction of the nozzle arrays 30, thereby forming the provisional hole 44 in each nozzle array 30 by each punch 42. In any method, the punch 42 is moved along a virtual center line 51 set to the formation position of the nozzle array 30, thereby carrying out the punching continuously.

The direction of the movement of the punch 42 can be set properly. For example, the punch 42 may be moved in the odd-numbered nozzle arrays 30A, 30C, 30E and 30G from the upstream side of the virtual center line 51 to the downstream side thereof (in the same positive direction as the feeding direction of the material plate 43, a direction shown in an arrow of FIG. 4B), and the punch 42 may be moved in the even-numbered nozzle arrays 30B, 30D, 30F and 30H from the downstream side of the virtual center line 51 to the upstream side thereof (that is, in a reverse direction to the feeding direction of the material plate 43). For all the nozzle arrays 30A to 30H, moreover, it is also possible to carry out the punching while moving the punch 42 in the positive direction (or the reverse direction).

In the embodiment, a plurality of provisional holes 44 belonging to the same nozzle array 30 are fabricated by the punching using the same punch 42. In the nozzle orifices 21, therefore, nozzle profiles are aligned with high precision. Consequently, it is possible to prevent a variation in the jet characteristic of an ink drop which is caused by a variation in the nozzle profile, for example, a variation in a flight speed, a flight direction and an ink amount, and it is possible to cause the jet characteristic to be uniform on a high level. In the case in which all the provisional holes 44 are to be formed from the first nozzle array 30A to the eighth nozzle array 30H by one punch 42, the nozzle profiles of all the nozzle orifices 21 provided in the nozzle plate 22 are aligned with high precision. Therefore, it is possible to cause the jet characteristic to be uniform on a high level. In the embodiment, furthermore, the punching is carried out by one punch 42. Therefore, it is possible to decrease the number of the punches 42 to be used and to reduce a man-hour and a cost which are required for punch fabrication.

On the other hand, in the case in which the provisional hole 44 in each nozzle array 30 is formed by causing one punch 42 to correspond to one nozzle array 30, the punching (provisional hole processing) is carried out by using a plurality of punches 42 so that the punching for the nozzle arrays 30 can be progressed at the time, resulting in an enhancement in productivity. While the processing method requires to prepare the punches 42, the number of the nozzle arrays 30 to be processed is enough. For this reason, the number itself is not remarkably increased. For example, in the case in which the nozzle plate 22 in FIG. 4 is to be fabricated, eight punches 42 are enough. Consequently, it is sufficiently possible to prepare the punches 42 having equal dimensions and to attach the punches 42 to the punch holder 48 with high precision in the dimension.

In the case in which the nozzle orifices 21 in a plurality of lines are fabricated by this method, a tolerance in the nozzle array becomes smaller than that between the nozzle arrays in relation to the nozzle profile. Referring to the straight portion 21*a* to be a factor which can influence the jet characteristic of the ink drop most greatly, particularly, the tolerance in the nozzle array is set to be smaller than the tolerance between the nozzle arrays. The reason is as follows. More specifically, the provisional hole 44 in the nozzle array is formed by the same punch 42 so that the nozzle profiles are aligned with high precision, while a difference is made in the nozzle profile depending on precision in the dimension and attachment of the punch 42 between the nozzle arrays.

In this case, referring to a variation in the jet characteristic which is caused by the nozzle orifice 21, a variation between the nozzle arrays is greater than that in the nozzle array. In the recording head 11 of this kind, usually, driving conditions can be set to each nozzle array. The reason is that the components of the recording head 11, for example, the piezoelectric vibrator 16 and the pressure generation chamber 23 are fabricated by setting the nozzle array 30 to be a unit and the jet characteristic of the ink drop is apt to be varied on the nozzle array unit depending on a difference in a characteristic or a difference in a shape.

Accordingly, even if the jet characteristic is varied between the nozzle arrays, a countermeasure can be taken by setting the driving conditions. For example, it is possible to carry out regulation by controlling the driving voltage and the driving waveform of a driving pulse for jetting the ink drop, and furthermore, an impact ink amount per unit area. As a result, a variation in the jet characteristic which is caused by the nozzle orifice 21 can be regulated according to a variation in a characteristic which is caused by each component such as the piezoelectric vibrator 16 or the pressure generation chamber 23. Thus, the variation can be regulated easily.

Next, a second embodiment will be described. The second embodiment is characterized in that a plurality of punches 42 are attached to a punch holder 48 (a kind of a holding member in the invention) at an interval corresponding to an interval between nozzle arrays to make a punch set 52 (for example, a first punch set 52A to a third punch set 52C, see FIG. 4B). Punching is simultaneously carried out in a plurality of lines by the punches 42 attached to the punch holder 48, and the punch set 52 is then moved in the direction of the nozzle arrays 30, thereby carrying out the punching for next plural lines. In the embodiment, the punching for the lines sequentially progresses in a synchronous state. More specifically, the punching in the plural lines is simultaneously carried out on a punch unit of the punch set 52. Therefore, the processing can be carried out more efficiently so that productivity can be enhanced.

In the embodiment, an interval of arrangement between the punches 42 is set according to the specification of the nozzle plate 22 to be fabricated. The specification of the nozzle plate 22 will be described. In the example of FIG. 4B, a nozzle array set 50 is constituted by a pair of nozzle arrays 30 which are adjacent to each other. More specifically, a first nozzle array set 50A is constituted by a first nozzle array 30A and a second nozzle array 30B, and a second nozzle array set 50B is constituted by a third nozzle array 30C and a fourth nozzle array 30D. Similarly, a fifth nozzle array set 50C is constituted by a fifth nozzle array 30E and a sixth nozzle array 30F, and a fourth nozzle array set 50D is constituted by a seventh nozzle array 30G and an eighth nozzle array 30H. These four nozzle array sets 50A to 50D are provided transversely each other. More specifically, the nozzle array set 50 is provided in an orthogonal direction to the nozzle array direction (the direction of arrangement of the nozzle orifice 21). In this example, moreover, an array interval L2 between the nozzle array sets 50 is set to be greater than a formation interval L1 between the nozzle arrays 30 in the nozzle array set 50.

The first punch set 52A includes two punches 42 and an attachment interval between the punches 42 is made equal to the formation interval L1 between the nozzle arrays 30. Accordingly, in the case in which the first punch set 52A is used, the punching is carried out on a nozzle array set 50 unit. For example, the punching is first carried out for the first nozzle array set 50A, and the punch set 52 is then moved in the direction of the nozzle arrays 30 by a distance which is equivalent to the interval L2. If the punch set 52 is moved, the punching for the second nozzle array set 50B is carried out. Subsequently, the punching for the third nozzle array set 50C and the punching for the fourth nozzle array set 50D are carried out in the same manner.

A plurality of first punch sets 52A can also be used at the same time. For example, it is also possible to use four punch sets 52A in total by causing one punch set 52A to correspond to one nozzle array set 50. In this case, the four nozzle array sets 50 are subjected to the punching at the same time, resulting in a high working efficiency. Similarly, the punching for two nozzle array sets 50 may be carried out at the same time by using two punch sets 52A.

Moreover, a second punch set 52B includes two punches 42 and an attachment interval between the punches 42 is made equal to the formation interval L2 between the nozzle array sets 50. Accordingly, in the case in which the second punch set 50B is used, the punching is carried out for one of the nozzle arrays 30 in the adjacent nozzle array sets 50. For example, first of all, the punching is carried out for the left side line of the first nozzle array set 50A (the first nozzle array 30A) and the left side line of the second nozzle array set 50B (the third nozzle array 30C). Next, the punch set 52 is moved in the direction of the nozzle arrays 30 by a distance which is equivalent to the interval L1 so that the punching is carried out for the right side line of the first nozzle array set 50A (the second nozzle array 30B) and the right side line of the second nozzle array set 50B (the fourth nozzle array 30D). Subsequently, the punching is carried out for the third nozzle array set 50C and the fourth nozzle array set 50D in the same manner. In this case, each line of the adjacent nozzle array sets 50 can be subjected to the punching at the same time. Therefore, the productivity can be enhanced.

Moreover, the third punch set 52C includes four punches 42 and the attachment interval between the adjacent punches 42 is made equal to the formation interval L2 between the nozzle array sets 50. More specifically, a second punch 42 from the left is attached to a position having the interval L2 and a third punch 42 from the left is attached to a position having a double of the interval L2 (2×L2) on the basis of the punch 42 at the left end. Similarly, the punch 42 on the right end is attached to a position having an interval which is three times as much as the interval L2 (3×L2). In the punching using the third punch set 52C, accordingly, a processing for one of the nozzle arrays 30 in the nozzle array set 50 and a processing for the other nozzle array 30 are carried out separately.

For example, first of all, the punching is carried out for the left side line of the nozzle array set 50 (the odd-numbered nozzle arrays 30A, 30C, 30E and 30G). When the punching in the left side line is ended, the third punch set 52C is moved in the direction of the nozzle arrays 30 by the interval L1. Then, the punching is carried out for the right side line of the nozzle array set 50 (the even-numbered nozzle arrays 30B, 30D, 30F and 30H).

In this case, four nozzle array sets 50 are provided and the third punch set 52C includes four punches 42, that is, the number of the punches provided in the third punch set 52C is equal to that of the nozzle array sets 50. Therefore, one of the nozzle arrays 30 in the nozzle array set 50 is processed and the third punch set 52 is then moved in the direction of the nozzle arrays in the nozzle array sets 50 by the line interval L1 to simply process the other nozzle array 30 in the nozzle array set 50, which is effective for enhancing the productivity.

By using the punch sets 52A to 52C, the punching for plural lines is simultaneously carried out on a punch set unit. For this reason, the processing can be carried out efficiently to enhance the productivity. Moreover, it is possible to easily set the amount of movement in the direction between the lines of the punch set 52 in the punching. For example, in the processing using the first punch set 52A, it is preferable that the punch set 52A should be moved by a distance corresponding to the interval L2 every time the punching for one nozzle array set 50 is ended. In the processing using the third punch set 52C, if the punching for the nozzle array 30 on one of sides is ended, it is preferable that the punch set 52C should be moved by a distance corresponding to the interval L1. For this reason, the provisional hole 44 can be formed with high precision in a position and the processing can be carried out more efficiently.

With such a structure, it is necessary to prepare a plurality of punches 42. The number of the nozzle arrays 30 to be processing objects is enough. Therefore, the number itself is not remarkably increased. Consequently, it is sufficiently possible to prepare a plurality of punches 42 having equal dimensions and to attach the punches 42 to the punch holder 48 with high precision in the dimension, which is suitable for practical use.

In the structure, moreover, the processing using the punches 42 is carried out. Referring to a variation in a jet characteristic which is caused by the nozzle orifice 21, therefore, a variation between the nozzle arrays can be larger than that in the nozzle array. As described above, however, the variation can be regulated corresponding to a variation in a characteristic which is caused by each component such as the piezoelectric vibrator 16 or the pressure generation chamber 23. Therefore, there is no hindrance to practical use.

While there has been illustrated the nozzle plate 22 in which the array interval L2 between the nozzle array sets 50 is set to be larger than the formation interval L1 between the nozzle arrays 30 in the nozzle array set in the second embodiment, the invention can also be applied to the nozzle plate 22 having the nozzle arrays 30 provided at regular intervals. A third embodiment having such a structure will be described below.

Figure 5:
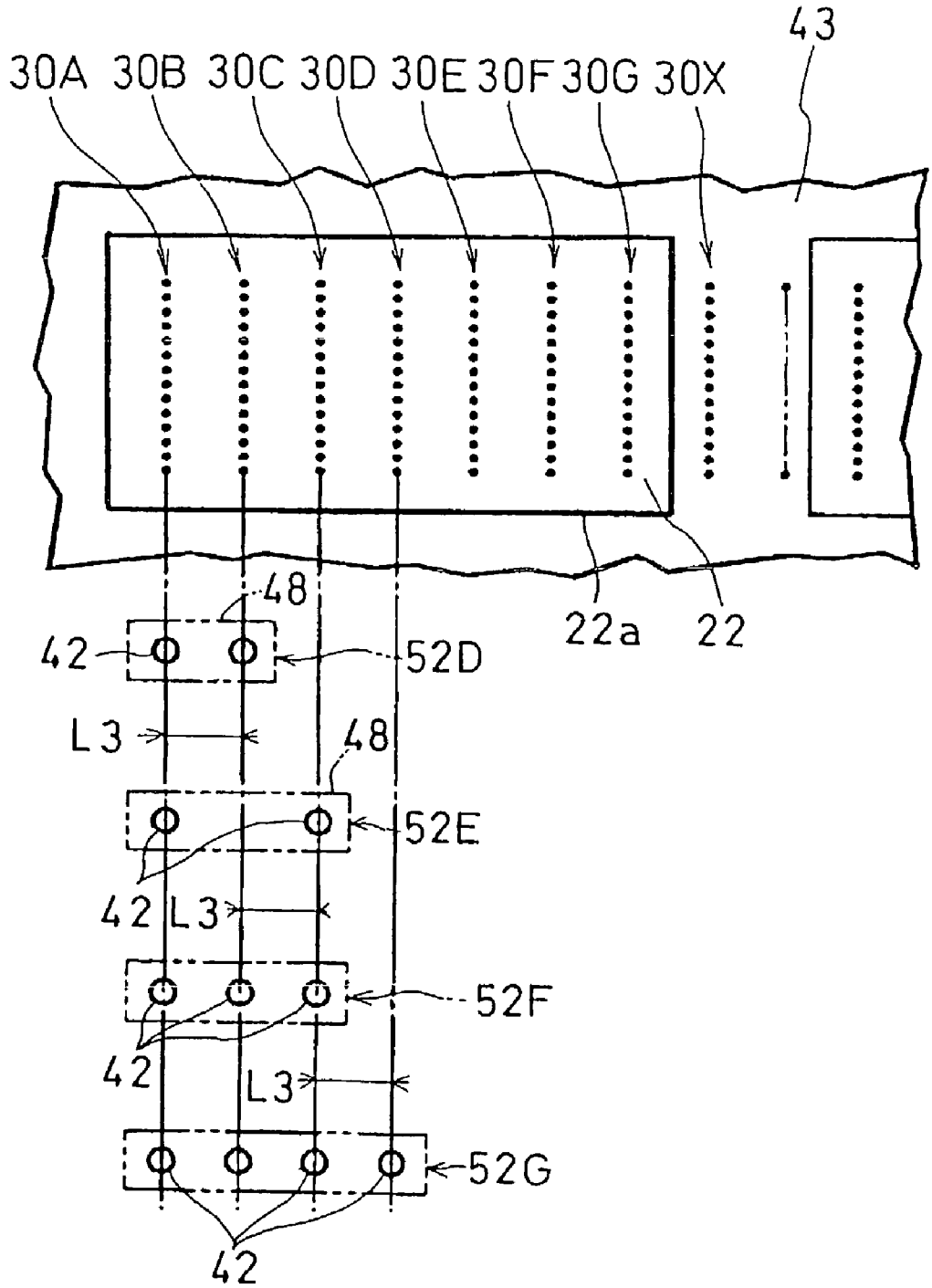
FIG. 5 is a view illustrating a provisional hole forming step according to a third embodiment.

As shown in FIG. 5, in the third embodiment, nozzle arrays 30 (30A to 30G) are formed transversely at an interval L3. In a punch set 52 (52D to 52G) to be used in this example, an interval between adjacent punches 42 is set to be integer times as much as a formation interval L3 between the nozzle arrays 30. In this example, punching for the nozzle arrays 30 is ended and the punch set 52 is then moved in the direction of the nozzle arrays 30 by a distance defined by the formation interval L3 between the nozzle arrays 30, thereby carrying out the punching for the next nozzle array 30.

For example, a fourth punch set 52D includes two punches 42 and an attachment interval between the punches 42 is made equal to the formation interval L3 between the nozzle arrays 30. In the punching using the fourth punch set 52D, the processing is carried out for two adjacent nozzle arrays 30 at the same time. For example, the punching is carried out for the first nozzle array 30A and the second nozzle array 30B and the punch set 52D is then moved in the direction between the lines by a distance corresponding to a double of the interval L3, thereby carrying out the punching for the third nozzle array 30C and the fourth nozzle array 30D. Subsequently, the punching for the fifth nozzle array 30E and the sixth nozzle array 30F and the punching for the seventh nozzle array 30G are carried out in the same manner.

In this case, a surplus nozzle array 30X is generated based on the relative relationship between the number of the punches 42 provided in the punch set 52D and that of the nozzle arrays 30. In such a case, the surplus nozzle array 30X is extra punched in a surplus region positioned on the outside of an external line 22*a* of a nozzle plate 22. Consequently, it is possible to minimize the type of the punch set 52 to be used. More specifically, even if the punch set 52 dedicated to one line is not prepared separately, the punching can be carried out by only the fourth punch set 52D. Furthermore, there is an advantage that a countermeasure can easily be taken against the case in which the specification of the nozzle plate 22 is changed.

Moreover, the fifth punch set 52E includes two punches 42 and an attachment interval between the punches 42 is set to be a double of the formation interval L3 between the nozzle arrays 30. In the punching using the fifth punch set 52E, two nozzle arrays 30 are alternately subjected to the punching. For example, the punching for the first nozzle array 30A and the third nozzle array 30C is carried out and the punch set 52 is then moved in the direction of the lines by a distance which is equivalent to the interval L3, thereby carrying out the punching for the second nozzle array 30B and the fourth nozzle array 30D. Thereafter, the punch set 52 is moved in the direction of the lines by a distance which is equal to three times as much as the interval L3, thereby carrying out the punching for the fifth nozzle array 30E and the seventh nozzle array 30G. Finally, the punching is carried out for the sixth nozzle array 30F and the surplus nozzle array 30X.

Moreover, the sixth punch set 52F includes three punches 42 and an attachment interval between the adjacent punches 42 is set to the formation interval L3 between the nozzle arrays 30, and the seventh punch set 52G includes four punches 42 and an attachment interval between the adjacent punches 42 is set to the formation interval L3 between the nozzle arrays 30. The punching for three nozzle arrays 30 is collectively carried out by the sixth punch set 52F, and the punching for four nozzle arrays 30 is collectively carried out by the seventh punch set 52G.

In these examples, the intervals between the adjacent nozzle arrays 30 are equal to each other and the interval of arrangement between the adjacent punches 42 is set to be integer times as much as the interval between the nozzle arrays. Therefore, the interval of attachment between the punches 42 is set based on the interval between the nozzle arrays, and furthermore, the moving distance of the punch set 52 is also set based on the interval between the nozzle arrays. Accordingly, it is possible to simply set the interval of attachment between the punches 42 and the moving distance in the direction between the lines of the punch set 52. Consequently, the amount of movement of the punch set 52 can be set with high precision and the provisional hole 44 can be formed with high precision in a position. Furthermore, the processing can be carried out more efficiently.

Next, a fourth embodiment will be described. The fourth embodiment is characterized in that a large-sized material plate capable of fabricating a plurality of nozzle plates 22 is used for a material plate. In this example, the provisional hole forming step and the bulged portion removing step are carried out for the large-sized material plate. Then, a dividing step is started to cut the large-sized material plate for each nozzle plate so that a plurality of nozzle plates 22 are obtained.

Figure 6:
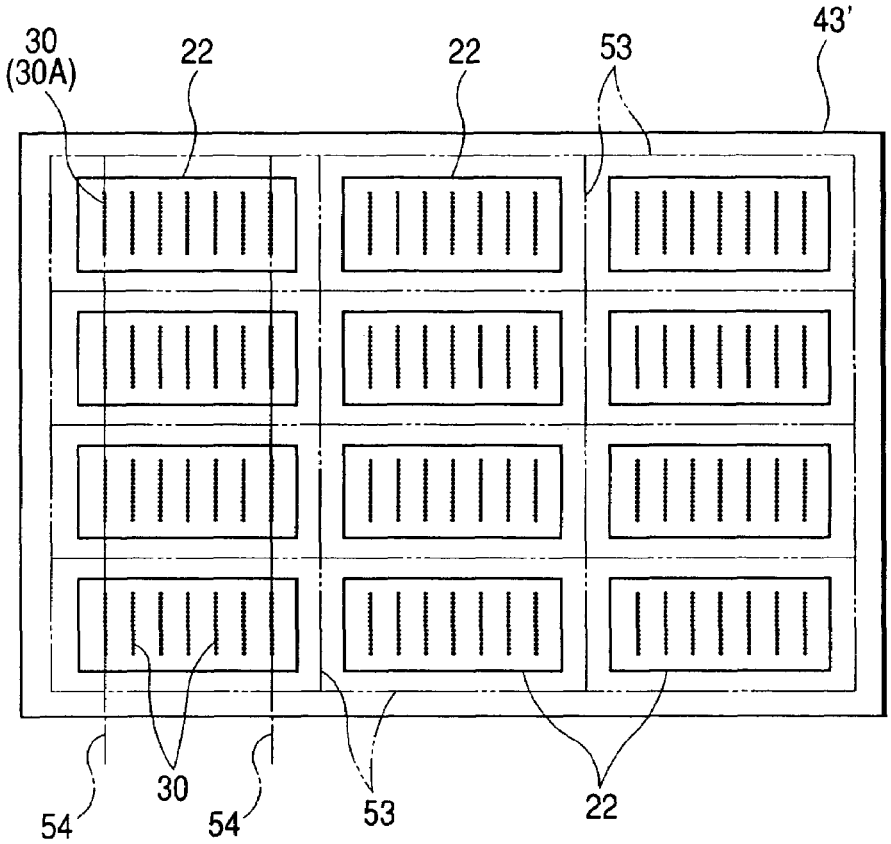
FIG. 6 is a plan view showing a large-sized material plate according to a fourth embodiment.
Figure 7:
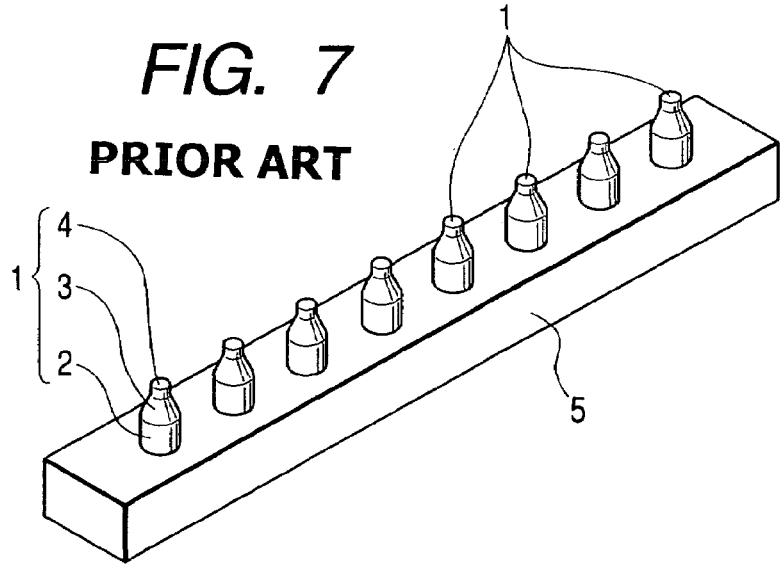
FIG. 7 PRIOR ART
FIG. 7 is a perspective view showing a related punch.
Figure 8:
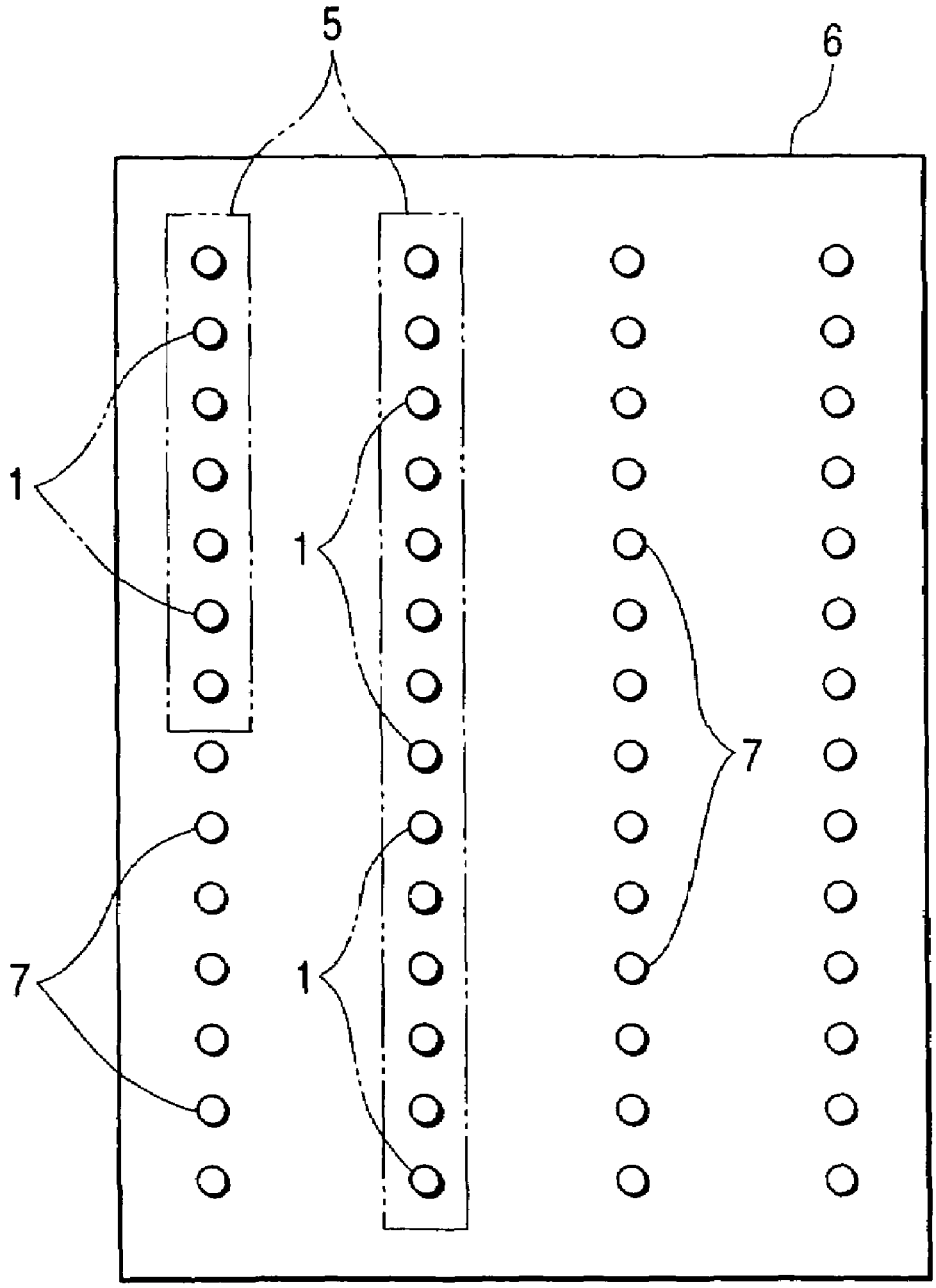
PRIOR ART FIG. 8
FIG. 8 is a view illustrating a provisional hole forming step according to the related art.
Figure 9A:
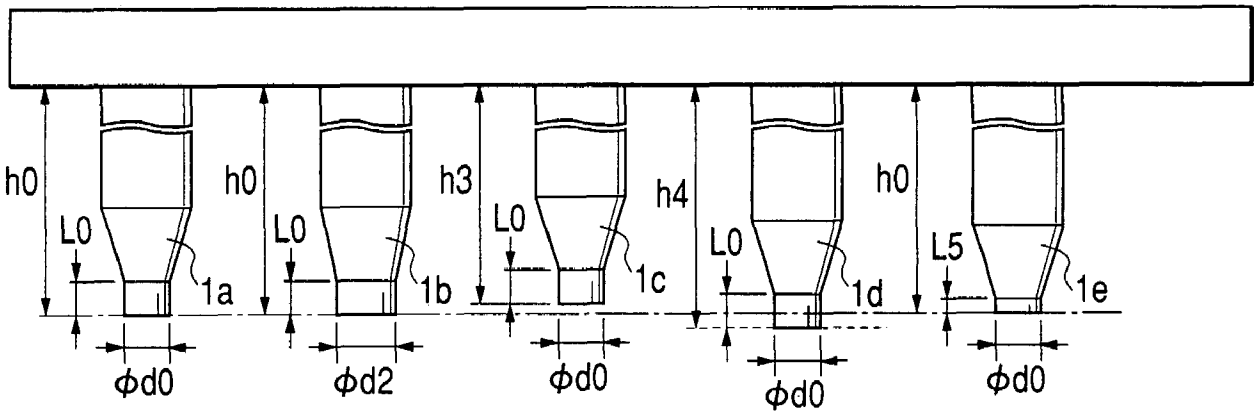
FIG. 9A PRIOR ART
FIGS. 9A to 9C are views illustrating a problem with respect to the related punch.
Figure 9B:
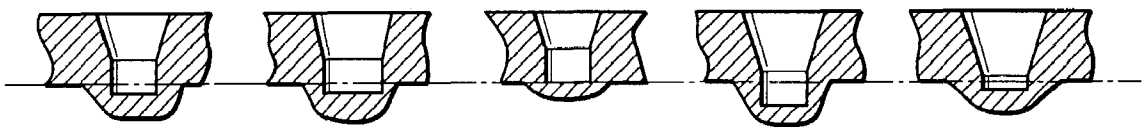
FIG. 9B PRIOR ART
Figure 9C:
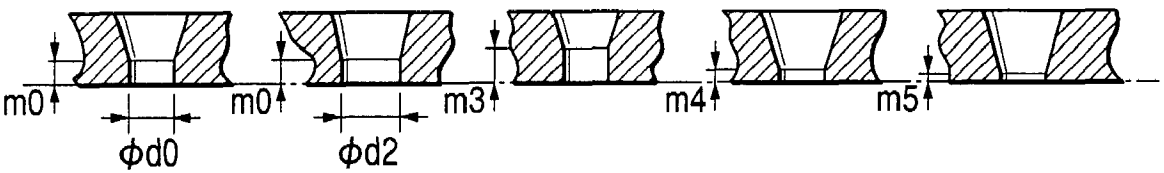
FIG. 9C PRIOR ART

FIG. 6 is a view illustrating a large-sized material plate 43' to be used in this example. In the large-sized material plate 43' thus illustrated, three nozzle plate regions are set in a lateral direction and fourth nozzle plate regions are set in the direction of a nozzle array (the regions act as the nozzle plates 22 and are surrounded by a cutting line 53 shown in a two-dotted chain line). Consequently, twelve nozzle plates 22 can be fabricated from one large-sized material plate 43'. Seven nozzle arrays 30 are formed transversely at regular intervals over the nozzle plate 22. Referring to the forming position of the nozzle array 30, moreover, the nozzle arrays 30 corresponding to each other are formed to be provided on a virtual center line 54 between the adjacent nozzle plates 22 in the direction of the nozzle array. For example, in FIG. 6, a first nozzle array 30A in each of the four nozzle plates 22 positioned on the left side is provided on the same straight line. The foregoing is the same as in other nozzle arrays 30.

Also in the large-sized material plate 43', the provisional hole forming step is carried out in the procedure described in each of the embodiments. For example, there is prepared the punch set 52 having seven punches 42 attached transversely corresponding to seven nozzle arrays 30 provided in one nozzle plate 22, and each corresponding provisional hole 44 is simultaneously formed by the punch set 52. Moreover, three punch sets 52 may be prepared and may be provided transversely to form all the provisional holes 44 at the same time. If the provisional hole 44 is formed, the bulged portion removing step is started to remove a bulged portion 49 by polishing. Then, the bulged portion 49 is removed to cause the provisional hole 44 to penetrate in the direction of the thickness of the plate, thereby forming a nozzle orifice 21. Then, the dividing step is carried out to cut the large-sized material plate 43' for each nozzle plate 22. In this case, first of all, the large-sized material plate 43' is cut along the cutting line 53. Thereafter, a surplus portion on the outside is trimmed to obtain the nozzle plate 22 having a determined dimension. In this example, the provisional hole forming step and the bulged portion removing step are carried out in the state of the large-sized material plate 43', and subsequently, the dividing step is started to carry out a division into the nozzle plates 22. Consequently, productivity can be enhanced remarkably. Furthermore, in the case in which a plurality of punch sets 52 are prepared to form all the provisional holes 44 at the same time, the productivity can be enhanced still more.

In this example, moreover, even if various array patterns of the nozzle arrays 30 are set for each nozzle plate 22, for instance, also in the case in which the nozzle plate 22 having a plurality of nozzle arrays 30 formed at regular intervals (an equal pitch) and the nozzle plate 22 formed at unequal intervals (the intervals between the nozzle arrays are uneven) are mixed in one large-sized material plate 43', a countermeasure can easily be taken. For example, it is possible to fabricate numerous numbers of nozzle plates 22 in one large-sized material plate 43' by setting the number of the punches 42 provided in the punch set 52 or the attachment interval between the punches 42 and setting the amount of movement in the direction of the lines of the punch set 52. Thus, the productivity can be enhanced still more.

While the recording head 11 to be a kind of liquid jetting head has been taken as an example in the embodiment, the invention can also be applied to other liquid jetting heads, for example, a coloring material jetting head for a display manufacturing apparatus, an electrode material jetting head for an electrode forming apparatus or an organism jetting head for a biochip manufacturing apparatus.

Moreover, while the piezoelectric vibrator 16 has been illustrated for a pressure generating element in each of the embodiments, this is not restricted. It is sufficient that the pressure generating element can generate a fluctuation in a pressure over a liquid in the pressure generation chamber 23, for example, it is a magnetostrictive element to be a kind of an electromechanical converting element or a heat generating element which bumps the ink in the pressure generation chamber 23.

What is claimed is:

1. A method of manufacturing a nozzle plate comprising the steps of:

providing a large-sized material plate capable of fabricating a plurality of nozzle plates;

providing a single punch;

punching the material plate by the single punch so as to form a provisional hole;

forming a linear array of nozzles by repeating the punching step such that the provisional holes of the linear array are all formed by the single punch;

removing a bulged portion, from a back side of the material plate, so as to form the nozzles; and dividing the large-sized material plate into a plurality of nozzle plates.

2. The method as set forth in claim 1, wherein sets of linear arrays are arranged on the material plate in parallel with each other.

3. The method as set forth in claim 2, wherein a plurality of punches are provided in a first direction in which the sets of linear arrays are arranged; and wherein the sets of linear arrays respectively correspond to the punches that are formed by a corresponding punch.

4. The method as set forth in claim 3, wherein a punch set includes the punches attached to a holding member at an interval between the linear arrays, the method further comprising moving the punch set in a second direction to perform the punching step for subsequent sets of linear arrays.

5. The method as set forth in claim 4, wherein:

the punching is performed such that formation intervals between the linear arrays are equal to each other;

attachment intervals between the punches of the punch set are set at an integer times as much as the formation interval; and the moving function is performed such that the punch set is moved at least by the formation interval.

6. The method as set forth in claim 5, wherein the attachment interval between the punches of the each punch set is equal to the formation interval between said sets of linear arrays; and wherein the moving function is performed such that the punch set is moved at least by the interval between said sets of linear arrays.

7. The method as set forth in claim 4, wherein:

a linear array set is constituted by a pair of the adjacent linear arrays;

a nozzle array set is constituted by a pair of the adjacent nozzle arrays;

the punching step is performed such that an array interval between the linear array sets is larger than the formation interval between the linear arrays of the linear array set; and the moving step is performed such that the punch set is moved to perform the punching step for other plurality of linear arrays after the punching step for the linear arrays by the punch sets is finished.

8. The method as set forth in claim 1, wherein the punch set has the number of punches which corresponds to the number of linear arrays; and wherein the punching function is performed with respect to the plurality of nozzle plates simultaneously.

9. The method as set forth in claim 8, wherein the punching function is performed such that the linear arrays are formed on each nozzle plate by the corresponding punch set simultaneously.

10. The method as set forth in claim 1, wherein the punching function is performed such that the provisional holes corresponding to a surplus linear array are punched in a surplus region of the large-sized material plate.

* * * * *